United States Patent [19]

Bauman, Jr. et al.

[11] 4,022,135

[45] May 10, 1977

[54] LIFT SHEET

[75] Inventors: Edward W. Bauman, Jr., Chadds Ford, Pa.; Edwin J. McLean, Lansing, Mich.

[73] Assignee: Scott Paper Company, Philadelphia, Pa.

[22] Filed: Sept. 11, 1975

[21] Appl. No.: 612,270

[52] U.S. Cl. ..... 108/51.3; 214/10.5 R

[51] Int. Cl.[2] ..... B65D 19/22

[58] Field of Search ..... 108/51.3, 51.1, 52.1, 108/57.1, 56.1; 206/386; 214/10.5 R; 248/346, 151, 152, 174

[56] References Cited

UNITED STATES PATENTS

| | | | |
|---|---|---|---|
| 2,328,397 | 8/1943 | Neuman | 108/57 X |
| 2,702,682 | 2/1955 | Newsom | 108/56 |
| 2,913,206 | 11/1959 | Paris | 108/51 |
| 2,918,242 | 12/1959 | Olivette et al. | 108/51 |
| 3,055,624 | 9/1962 | Wilson | 108/51 |
| 3,199,764 | 8/1965 | Oliver et al. | 108/54 X |
| 3,453,973 | 7/1969 | Vose et al. | 108/56 X |
| 3,709,161 | 1/1973 | Kauffman | 108/51 |
| 3,763,792 | 10/1973 | Webb | 108/51 |
| 3,776,145 | 12/1973 | Anderson et al. | 108/51 |

OTHER PUBLICATIONS

"Scott Paper Company Announces Uni-Step", 1964.

*Primary Examiner*—Roy D. Frazier
*Assistant Examiner*—William E. Lyddane
*Attorney, Agent, or Firm*—Bruce Hart; Martin L. Faigus; William J. Foley

[57] ABSTRACT

A disposable lift sheet formed of paper board having beneath one edge of the platform portion thereof a multiple layer stack of strips which provide a pierceable target area for the forks of the lift truck. The target area strips in the upper portion of the stack are wider than the strips in the lower portion of the stack to provide gradual stepped support for the platform portion and to reinforce the fork entry region of the lift sheet and prevent accidental piercing of the platform portion and the supported load thereon by the forks. In the preferred embodiment the target area strips are integral with the platform portion and are provided by reverse folding edge portions of the base sheet from which the lift sheet is made.

4 Claims, 4 Drawing Figures

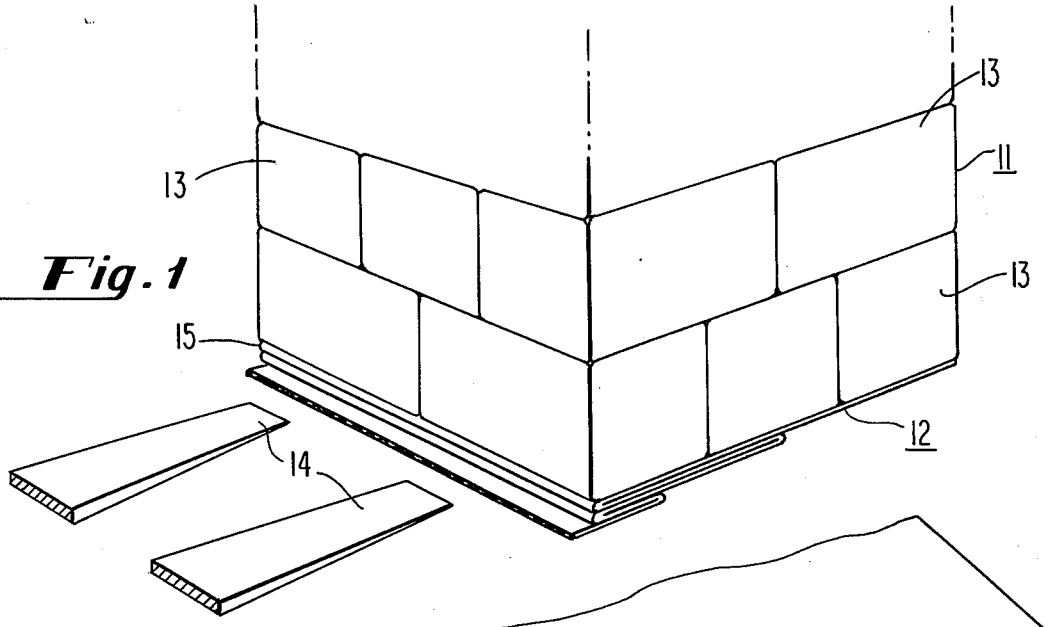
Fig. 1
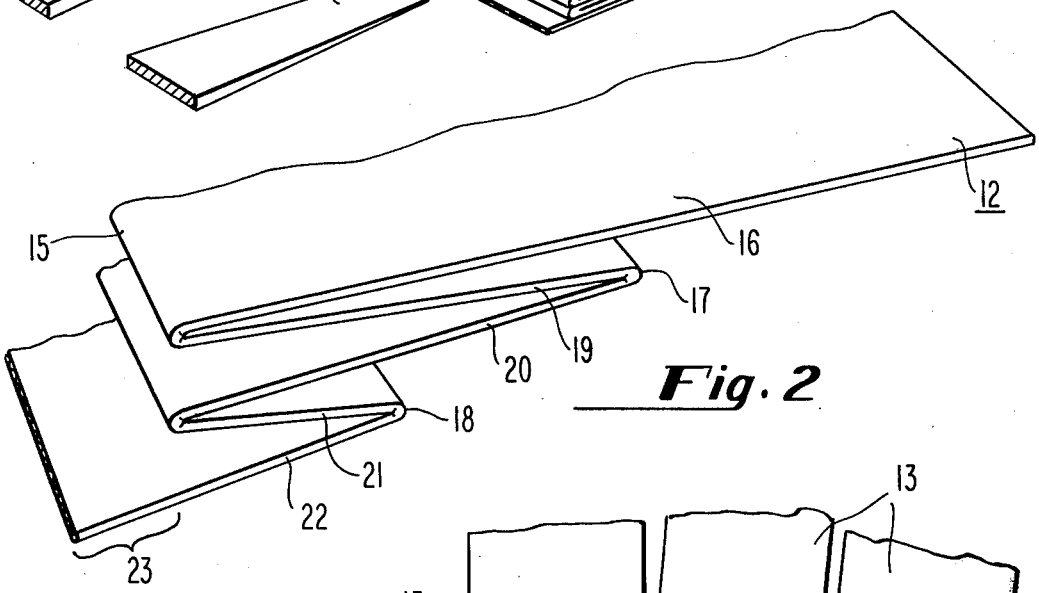
Fig. 2
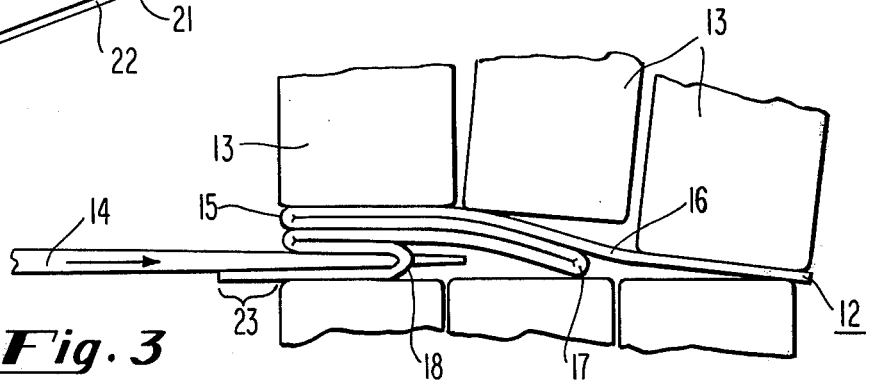
Fig. 3
Fig. 4
PRIOR ART
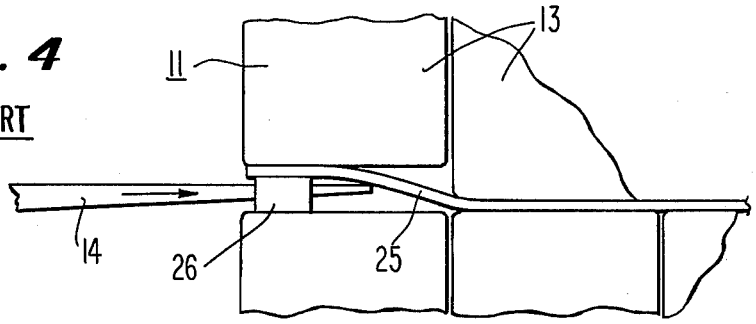

LIFT SHEET

BACKGROUND OF THE INVENTION

1. Field of the Invention in the handling and transportation of various goods it has become conventional practice to group together the goods or packages of goods into unit loads capable of being handled by self propelled lift trucks. A pallet is usually required to support and facilitate the handling of such a unit load. The most common pallets are constructed of wood strips fastened together to provide a support platform, a base and spacers connecting the platform and the base and providing openings for the entry of the forks of a lift truck.

Wooden pallets are well suited to the handling of heavy unit loads requiring the strength and durability of a wood structure, but there are many applications for which the properties of wood are not required and in which wood pallets are simply too expensive, unless reused for many different shipments at great inconvenience to the supplier and the receiver of the goods. There have been, therefore, many attempts to devise inexpensive replacements for wood pallets and the goal of such endeavors has generally been a palletlike structure of sufficient low cost to be disposable after a single use in transit and yet having sufficient integrity to provide reliable laod support during handling and transportation. Although some measure of success has been achieved, the structures previously proposed have had one or more shortcomings.

2. Description of Prior Art

One example of the prior attempts made to replace wooden pallets is illustrated by the disclosure in U.S. Pat. No. 3,055,624 to R. E. Wilson, wherein it is proposed that a pallet be constructed of corrugated paperboard by the technique of cutting, folding and glueing numerous strips of material to fabricate more or less conventional components of the pallet. Although the material used is inexpensive, the technique employed is costly and the savings realized are minimal.

A somewhat simpler pallet structure made from corrugated paperboard is disclosed in U.S. Pat. No. 3,453,973 to H. Vose III, et al, but again, a rather expensive cut, fold and fasten technique is employed to provide spacer feet for the pallet.

Possibly the simplest structures thus far devised are disclosed in U.S. Pat. No. 3,763,792 to W. A. Webb and 3,776,145 to R. F. Anderson, et al. The former suggests the use of a perforated, but otherwise unadorned, corrugated sheet while the latter promotes the use of a sheet of plastic having special surface characteristics. The principal disadvantage of the structures disclosed in these two patents lies in the fact that they are not pallets, at least not substitutes for wood pallets, but are mere slip sheets and require lift trucks with special gripper devices for grasping an edge of the sheet for lifting and pulling the load onto what usually is a solid platten on the lift truck. Only a limited number of warehouse facilities are equipped with the special lift trucks of this character and the load supported by the simple slip sheet cannot be readily handled by the conventional forked lift truck.

Lastly, by way of background, attention is directed to a pallet-like structure promoted and used by the assignee of the present invention and which consisted essentially of a single sheet of corrugated paperboard having several rectangular stacks of corrugated board adhesively secured to the underside of the sheet along one edge thereof. The spaced stacks of corrugated board provided therebetween spaces for entry of the forks of a lift truck to permit the sheet and the load thereon to be lifted with the truck forks. The structure and its utilization is described in a 1964 brochure entitled "Scott Paper Company Announces Uni-Step." Usage of this system has demonstrated certain weaknesses therein attributable primarily to the flexibility, i.e. lack of structural rigidity, of the corrugated paperboard sheet. Careless handling of the lift truck while the forks were being inserted beneath the sheet and load often resulted in the forks piercing the sheet and the load with consequent damage to the load. Secondly, a lift truck equipped with a multiplicity of forks, usually six, was required to prevent undesirable displacement of the components of the load during lifting because the pallet sheet offered substantially no beam support for anything but very light loads.

SUMMARY OF THE INVENTION

In the broad sense, the objective of this invention is to provide a low cost, disposable lift sheet capable of performing much as a wooden pallet for handling and transporting certain classes of multiple component loads. This objective recognizes and conceeds the superiority of wooden pallets for handling very heavy loads made up of machines, machine components, metal castings and the like. On the other hand, this invention renders the objective achievable for the handling of a wide variety of other goods and produce shipped in unit loads from manufacturer to wholesaler to retailer and from warehouse to warehouse. Such loads are frequently made up of goods or commodities packaged within packages and often have considerable bulk in relation to their weight.

A more specific objective is the provision of a lift sheet structure which can be fabricated with a minimum amount of material and with a minimum of manipulations of the base material.

These objectives are achieved according to the present invention by fabricating the lift sheet from conventional corrugated paperboard which has a platform portion for supporting the load and multiple sheet portions of the same material disposed in stacked relationship beneath and adjacent one edge of the platform portion of the sheet. The stacked sheet portions beneath the edge of the platform portion provide a piercable target area through which the lift truck operator propels the forks of his truck beneath the supported load. The sheet portions in the upper part of the stack extend inwardly of the platform portion a greater distance than the lower stack portions providing gradually stepped support for the platform so that it remains substantially planar when a load is placed thereon. The upper stack portions contribute to the integrity and strength of the platform portion in the region beneath which the initial entry of the lift truck forks is made between the load and a supporting surface.

BRIEF DESCRIPTION OF THE DRAWINGS

FIG. 1 is a partial perspective view of a multiple component unit load resting on a lift sheet embodying the invention and further illustrating portions of the forks of a lift truck positioned to be inserted beneath the load;

FIG. 2 is a partial perspective view of the lift sheet of this invention with the folds therein expanded for clarity of illustration;

FIG. 3 is a vertical elevational view illustrating entry of lift truck forks beneath a load supported by the lift sheet of this invention; and FIG. 4 is a vertical elevational view illustrating the entry of lift truck forks beneath a load supported by a lift sheet of the prior art.

DETAILED DESCRIPTION OF PREFERRED EMBODIMENTS

The type of multiple component unit load for which the lift sheet of this invention is particularly suited is designated by the numeral 11 in FIG. 1, wherein the lift sheet is designated generally by the numeral 12. The load 11 is made up of a plurality of boxes, or cartons, 13 which, in accordance with conventional practice, are in staggered or overlapping relationship from one layer to the next to contribute stability to the load. Such loads may be further stabilized by gluing contiguous cartons 13 to each other or by banding or wrapping the entire load and it is to be understood that this invention is applicable to such stabilized loads, although such characteristics are in many cases not required of loads supported by the lift sheet 12. A unit load 11 of this character intended for rail or truck transportation and for handling by lift trucks will have nominal length and width dimensions of from 40 to 50 inches and a height of from 2 to 5 feet. The weight of the load may be anywhere from 500 pounds to 1,000 pounds.

Such loads are customarily lifted and moved about by means of dual prong lift trucks which are self-propelled under control of a riding or walking operator. In FIG. 1 the forks of such a truck are designated by the numeral 14 and are shown in the position in which they would be placed by the lift truck operator just prior to being inserted beneath the load 11 to lift the load from a supporting surface.

In accordance with this invention the lift sheet 12 is provided at its front, or fork entry, edge 15 with a unique construction providing the multiple functions of adding beam strength and rigidity across the lift sheet, providing a target area for the entry of lift forks 14 and shielding the lift sheet against penetration by the forks. This construction is illustrated in FIG. 1 and amplified in FIG. 2. Lift sheet 12 has a platform portion, designated by the numeral 16, terminating in the aforementioned front edge 15 from which depend two, preferably integral, V-fold portions indicated at 17 and 18 respectively. The first V-fold portion 17 extends rearwardly from the front edge 15 of the sheet for a distance approximately one half of the depth of platform portion 16 and provides two stack sheet portions 19 and 20. Lower V-fold portion 18 similarly provides two stack sheet portions 21 and 22 which have a depth less than stack portions 19 and 20 and somewhat less than one fourth the depth of the platform portion 16 of the sheet 12.

Probably the simpliest technique for providing the multiple layer stack at the front edge 15 of the lift sheet 12 is to simply fold the two V-fold portions 17 and 18 from the same base sheet of material from which the platform portion 16 of the sheet is made. The functional effect when the folds are flattened beneath the front edge of the platform portion 16 is to provide a stack of spacer sheet portions the upper two of which, 19 and 20, are longer than the lower two, 21 and 22. Adjacent surfaces of stack sheet portions 19 through 22 may be secured together by glueing or taping if desired to provide a more coherent structure for ease of handling when the lift sheet is not associated with a load. Such securement would serve to prevent V-fold portions 17 and 18 from flopping about as the lift sheet 12 is placed on a surface in preparation for depositing a load thereon. Once a load 11 is in place on the lift sheet 12, securement of the V-folds 17 and 18 normally is not necessary as the weight of the load tends to keep the folds flat and in proper position.

As mentioned previously, the folded multiple stack of board at the front edge of the lift sheet 12 serves several purposes. In the first place there are five thicknesses of board material beneath and serving to elevate the front edge of the unit load 11 thereby providing a target area for the operator to aim the forks 14 of the lift truck beneath the load 11. Secondly, the upper V-fold portion 17, comprising stack sheet portions 19 and 20, extends some distance back beneath the load 11 to act as a shield to ward off penetration of the points of the lift truck forks 14 into the platform portion 16 of the lift sheet and the load thereon. It is preferred that the operator of the lift truck insert forks 14 into the open mouth of the lower V-fold portion 18 so that both stack sheet portions 19 and 20 of V-fold 17 are above the forks and available to shield the lower surface of the platform portion 16. The relationship for preferred entry of the forks 14 is illustrated in FIG. 3. In one preferred embodiment of the invention the lift sheet 12 is provided with a guide extension 23 to assist the lift truck operator in locating the proper position to insert the forks 14.

The most economical manner of providing a guide extension 23 is simply to have a region of the lowermost stack sheet portion 22 extend forwardly beyond the front edge 15 of the platform portion 16. If desired, stack sheet portion 22 may be scored to permit guide extension 23 to be folded upwardly or downwardly in those instances where this will facilitate banding or otherwise securing the load 11 in place.

The third function of the stacked sheet portions 19 through 22 is to add rigidity and beam strength across the front edge of the lift sheet 12 to minimize transverse bending of the lift sheet as the lift truck forks 14 are inserted beneath, lifted and take up the weight of the load 11. Low cost corrugated board of the type used for fabricating the lift sheet 12, and of approximately 150 to 275 pounds test weight, is normally quite flexible in single thickness, but is capable of exhibiting considerable beam strength in multiple thicknesses as employed in the unique structure of this invention.

One of the principle disadvantageous of prior light weight lift sheets constructed of paper or corrugated board has been the tendency for the sheet and the load thereon to be pierced by the lift truck forks during the lifting procedure. This undesirable consequence of prior structures is illustrated in FIG. 4. In this arrangement a unit load 11 of cartons 13 is supported by a single flexible lift sheet 25 having spacer feet 26 disposed beneath and raising the front edge of the lift sheet. Because of the flexibility of sheet 25 it is possible for the second carton to the rear of the front edge of the load to shift downwardly with respect to the foremost carton 13 in a position vulnerable to being pierced by the points on the forks 14 as they are propelled beneath the load. The single thickness lift sheet 25 offers very little resistance to penetration by the forks 14. This condition often is exaggerated by the fairly common practice of jogging the lifting forks 14 upwardly as they are inserted beneath the load. In other words, the forks 14 often will be inserted a short distance beneath the load by the operator, then raised slightly and then moved further beneath the load. Such movements have a tendency to allow an even greater position discrepancy to be assumed by the various cartons 13 in the load with enhanced likelihood of rearward cartons being pierced by the forks 14. The result often is damaged and unsaleable merchandise.

The conditions just described with reference to FIG. 4 are to be contrasted with the condition illustrated in FIG. 3, depicting the load being lifted with the lift sheet 12 of the present invention. The V-fold portion 17 of the lift sheet extends rearwardly beneath the platform portion 16 of the sheet and provides a dual benefit. In the first place the two sheet portions 19 and 20 of Y-fold 17 impart some rigidity to the lift sheet 12 and reduce the possibility of relative displacement of the bottom faces of the cartons 13, so there is less chance for any one of the cartons to settle down into the path of the lift truck forks 14. Secondly, V-fold 17 acts as a shield to reduce the possibility of the forks 14 piercing the lift sheet 12.

The preferred embodiment of this invention has the lift sheet 12 fabricated from a unitary sheet of corrugated paperboard material which is folded to provide the V-fold portions 17 and 18. In addition to being an economical production technique this mode of construction imparts some additional rigidity to the lift sheet by virtue of the stiffness provided from the folds which are made in the base material. It should be apparent however that the stacked arrangement of sheet portions 19 through 22 at the front edge of the lift sheet 12 could be provided by separate strips of material. Such strips can be held together by a light application of glue to adjacent surfaces. Such an alternative construction, which is deemed to be within the scope of the invention, might be preferable when fabricating the lift sheet 12 from waste materials of which thin strips are already available.

It will also be noted that in the preferred embodiment of the invention the lower V-fold portion 18 extends rearwardly beneath the platform portion 16 substantially short of the upper V-fold portion 17. There are two benefits associated with this configuration. The first, which has been mentioned previously, is that the differing width V-folds 17 and 18 provide a gradual stepped-down support for platform portion 16 so as to avoid the formation of bends or undulations in the platform portion 16 under the weight of the supported load. Such bands, if allowed to form, act as load concentration pressure points which tend to crush and damage cartons 13 resting thereon. The second benefit is that the narrower V-fold 18 requires less material and its width can be varied to permit the lift sheet to be formed from standard width base material.

It should further be noted that the guide extension 23 protruding forward of the front edge 15 of platform portion 16 can be utilized for gripping the lift sheet 12 by the clamp like grippers with which some lift trucks are equipped. It is thus possible to utilize lift sheet 12 in those storage applications where the transportation equipment requires merely a simple slip sheet which is grasped to draw the load 11 onto another supporting structure.

What is claimed is:

1. A lift sheet for facilitating the lifting of a multiple component unit load from a supporting surface, said sheet comprising a platform portion for supporting a load on the upper surface thereof, said platform portion including a front, fork entry edge and an opposed rear edge, multiple sheet portions disposed in upper and lower stacked relationship beneath said platform portion and adjacent said front edge of said platform portion, the upper stack portions extending inwardly of said platform portion and terminating short of said rear edge, said lower stack portions extending inwardly of said platform portion a lesser distance than said upper stack portions whereby said upper and lower stacked portions provide a stepped configuration for maintaining said platform portion in substantially a planar position when said load is placed thereon.

2. The sheet defined in claim 1, wherein the lowermost stack portion extends outwardly of said edge of the platform portion.

3. A lift sheet for facilitating the lifting of a multiple component unit load from a supporting surface, said sheet comprising a platform portion for supporting a load on the upper surface thereof, said sheet including a front, fork entry edge and an opposed rear edge, a first integral double thickness fold portion extending inwardly from and beneath said front edge of said platform portion and a second integral double thickness fold portion extending from and beneath said first fold portion, said first fold portion extending inwardly of the platform portion and terminating short of said rear edge thereof, said second fold portion extending inwardly of the platform portion a lesser distance than said first fold portion whereby said upper and lower stacked portions provide a stepped configuration for maintaining said platform portion in substantially a planar position when said load is placed thereon.

4. The sheet defined in claim 3, wherein an edge region of said second fold portion extends outwardly of said edge of the platform portion.

* * * * *